United States Patent [19]

Casey

[11] Patent Number: 4,722,386

[45] Date of Patent: Feb. 2, 1988

[54] CASTING CORE SHAKEOUT

[75] Inventor: Dwight P. Casey, Lindenhurst, Ill.

[73] Assignee: General Kinematics Corporation, Barrington, Ill.

[21] Appl. No.: 41,729

[22] Filed: Apr. 23, 1987

[51] Int. Cl.[4] ..... B22D 29/02

[52] U.S. Cl. ..... 164/404; 164/260

[58] Field of Search ..... 164/131, 132, 260, 344, 164/345, 346, 401, 404

[56] References Cited

U.S. PATENT DOCUMENTS

| | | | |
|---|---|---|---|
| 4,168,724 | 9/1979 | Graffunder et al. | 137/884 |
| 4,495,826 | 1/1985 | Musschoot | 74/61 |

FOREIGN PATENT DOCUMENTS

| | | | |
|---|---|---|---|
| 0216396 | 12/1984 | Fed. Rep. of Germany | 164/345 |
| 85/02137 | 5/1985 | PCT Int'l Appl. | 164/345 |
| 2063739 | 6/1981 | United Kingdom | 164/404 |
| 929319 | 5/1982 | U.S.S.R. | 164/401 |
| 1227332 | 4/1986 | U.S.S.R. | 164/260 |

*Primary Examiner*—Nicholas P. Godici
*Assistant Examiner*—Richard K. Seidel
*Attorney, Agent, or Firm*—Wood, Dalton, Phillips, Mason & Rowe

[57] ABSTRACT

According to the invention, a vibratory apparatus is provided having a deck resiliently mounted relative to a surface bearing the vibratory apparatus, a clamp support for a casting on the deck, and a piston freely movably mounted relative to the deck. Vibration imparting structure vibrates the deck to shake out and to loosen foreign matter adhered to the casting supported on the deck and simultaneously reciprocates and ricochets the piston relative to the deck to further shake out and loosen foreign matter on the casting. A hammer plate is provided on the deck in the path of the piston. As the vibration imparting structure is operated, the piston is intermittently forcibly driven against the hammer plate to set up a different frequency of vibration than the frequency of the primary vibratory apparatus which enhances the shake out and cleaning function of the structure.

15 Claims, 7 Drawing Figures

FIG. 1
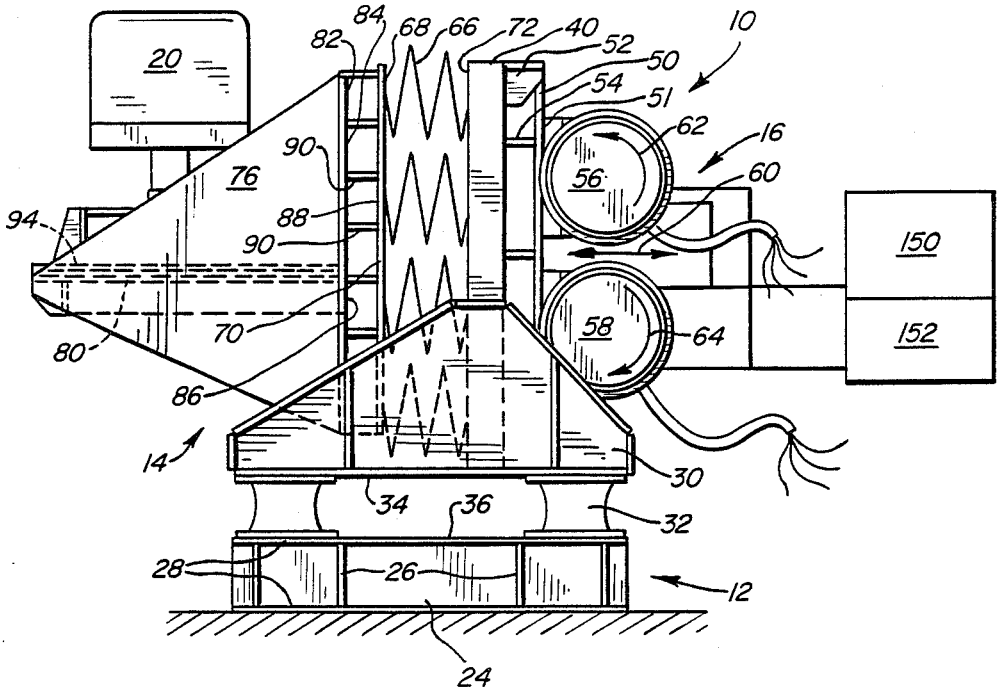
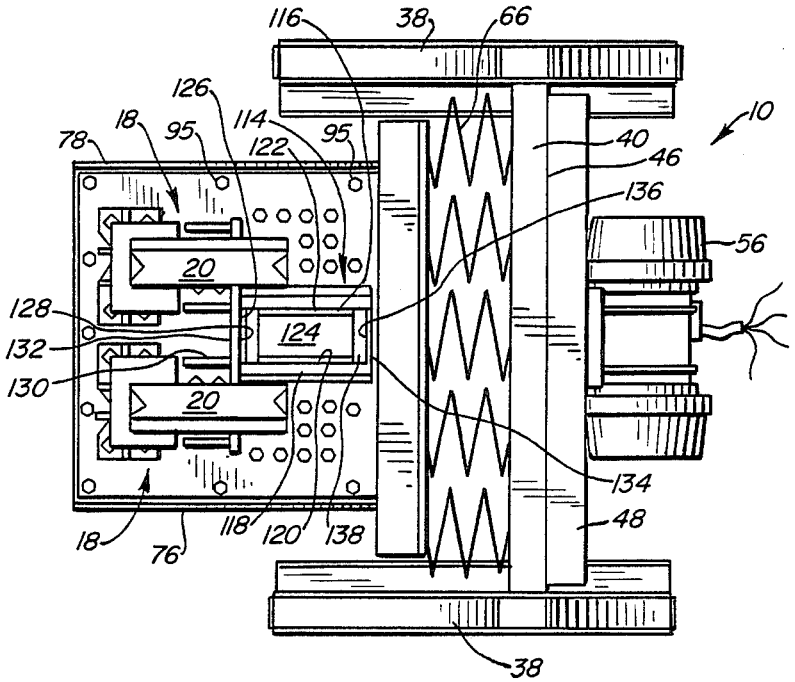
FIG. 2

CASTING CORE SHAKEOUT

BACKGROUND OF THE INVENTION

1. Field of the Invention

This invention relates to vibratory apparatus and, more particularly, to an apparatus for shaking out foreign matter adhered to a casting or the like.

2. Background Art

Intricate metal parts are often cast in sand molds. For example automobile engine blocks are commonly formed by this process. At the completion of the molding process, the sand mold must be broken away from the casting and any adhering sand particles, scale and other foreign matter removed.

Separation of the sand is commonly carried out through a vibratory apparatus. Vibration of the cast parts effectively breaks loose the majority of foreign material either adhering to the castings or trapped in crevices therein. While this procedure is very effective, there is inevitably foreign matter that is retained by the casting at the completion of the cleaning process.

SUMMARY OF THE INVENTION

According to the invention, a vibratory apparatus is provided having a deck resiliently mounted relative to a surface bearing the vibratory apparatus, a clamp support for a casting on the deck, and a free floating piston or knocker movably mounted relative to the deck. Vibration imparting structure vibrates the deck to break loose the foreign matter adhered on a casting supported on the deck and simultaneously activates the piston relative to the deck. A hammer plate is provided on the deck in the path of the piston. As the vibration imparting structure is operated, the piston is intermittently forcibly driven against the hammer plate creating a second set of vibratory impacts that breaks loose additional foreign matter.

The piston has sufficient mass to alter the vibration pattern of the deck and supported casting upon impacting the hammer plate. The casting is in effect impacted twice with different frequencies to clean foreign matter that would otherwise remain on the casting.

The invention comprehends a two-mass system. One mass is a vibration imparting exciter and vibratory apparatus which resiliently supports a second mass comprised of a deck assembly frame upon which the part to be cleaned is mounted. At least one, and preferably two motors having shafts carrying eccentric weights are attached to the exciter and cause vibration of the deck frame assembly in a substantially horizontal line.

The piston or knocker is mounted in a chamber on the deck plate for translatory movement back and forth in a line parallel to the line of movement of the exciter. The hammer plate bounds one end of the piston chamber and a second hammer plate, also on the deck, bounds the other chamber end. Under the action of the vibratory motion, the piston reciprocates freely back and forth and impacts alternatingly against the hammer plates at a greater frequency than the deck is vibrated. The piston adds an additional dimension to the vibration of the castings and tends to shake out matter that would otherwise remain adhered to the casting.

Preferably, clamp structure for the castings is provided on a first deck plate that is resiliently supported relative to a second, subjacent plate that is in turn fixedly attached to a force transmission plate, which is acted against by the exciter. This permits a modicum of relative movement of the deck plate relative to the underlying plate and adds an additional dimension to the vibration.

BRIEF DESCRIPTION OF THE DRAWINGS

FIG. 1 is a side elevation view of a vibratory apparatus according to the present invention;

FIG. 2 is a plan view of the apparatus in FIG. 1;

FIG. 4 is an elevation view taken from the end opposite that from which FIG. 3 is taken;

DESCRIPTION OF THE PREFERRED EMBODIMENT

In FIGS. 1–4, a preferred form of the invention is shown generally at 10 for vibrating a casting to dislodge and separate foreign material therefrom. It should be understood that the described use of the apparatus is not intended to be limiting, as it has applications in other fields.

Figure 4:
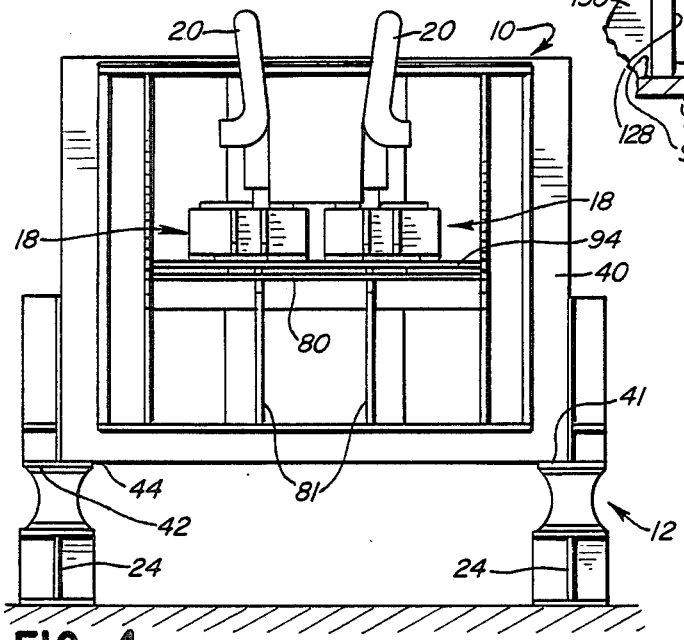

Briefly, the apparatus 10 comprises a base 12 for supporting a deck assembly 14 and vibration imparting structure 16 for the deck 14. Laterally spaced clamps 18 are provided to fixedly attach castings to the deck 14. In FIGS. 1 and 2, one configuration of casting 20 is shown secured in each of the clamps 18. FIG. 4 shows a different configuration of casting 22 in the clamp 18. The precise configuration of the casting, however, is not critical to the present invention.

The base 12 consists of two elongate, laterally spaced I-beams 24 having reinforcing gussets 26 between the vertically spaced flanges 28 thereon.

A platform 30 is provided above the beams 24 and is supported by four resilient mounts 32 interposed between the underside 34 of the platform 30 and the upper surfaces 36 of the beams 24. The platform 30 has laterally spaced, upright side plates 38, fixedly attached to the side edges of a laterally extending force transmission plate 40. Each resilient mount 32 has about one-half the width of its upper surface 41 bearing on the underside 42 of the side plates 38 and the other about one-half bearing on the underside 44 of the force transmission plate 40.

On the back side 46 of the force transmission plate 40, an exciter element 48 is rigidly attached. The exciter element 48 has a plate 50 with a rearwardly facing surface 51 that is substantially parallel to the back side 46 of the force transmission plate 40. The plate 50 is reinforced against fore and aft deflection by gussets 52 (one shown in FIG. 1) and ribs 54.

On the back side 51 of the exciter plate 50, two vibration imparting motors 56, 58 are mounted. These motors 56, 58 are of conventional construction and may be, for example, a type having a central shaft with an eccentric weight on each end thereof. Operation of the motors 56, 58 thereby vibrates the platform 30 and the associated plates 40, 50 back and forth in a line depicted by the double-headed arrow 60, as shown in FIG. 1. The motor and eccentric weight vibration imparting assemblies are to be of the variable force type whereby the stroke and frequency of the system can be changed. The variable force vibration assemblies may be of the type shown in U.S. Pat. No. 4,495,826 issued to Albert Musschoot. As indicated by arrows 62, 64 in FIG. 1, the shafts (not shown) of the motors 56, 58 rotate in opposite directions.

Figure 5:
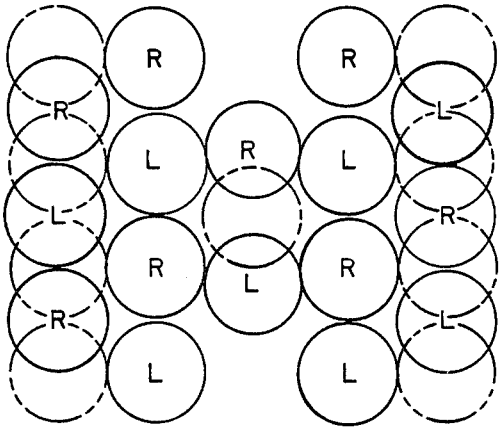
FIG. 5 is a schematic diagram showing the location of coil springs acting between a deck for supporting a casting and an exciter on the apparatus in FIGS. 1–4.

The deck 14 is supported entirely by a plurality of coil springs 66, which transmit vibration from the force transmission plate 40 to the deck 14. The deck has an upright plate 68 with a surface 70 facing a forwardly facing surface 72 on the force transmission plate 40. The springs 66 are interposed between the facing plate surfaces 70, 72. A preferred arrangement for the springs is shown in FIG. 5. In FIG. 5, the solid line circles identify a preferred location of each spring, whereas the phantom line circles show an alternative operative arrangement for the springs. The "R" and "L" in each circle designate right and left hand coil turns. The opposite coil turns assure that straight line vibration is maintained.

The deck 14 has laterally spaced, flat, triangular-shaped, side walls 76, 78 which are fixedly attached to a horizontal, flat plate 80. The plate 80 is rigidified by gussets 81 (FIG. 4). The rear edges 82 of the side walls 76, 78 are fixed to a mounting plate 84, having a rearwardly facing surface 86 parallel to a forwardly facing flat surface 88 on the plate 68. The plates 68, 84 are rigidly interconnected through reinforcing ribs 90. A fixed, unitary deck frame assembly is thus formed consisting of the plates 68, 84, side walls 76, 78 and plate 80. The vibration developed by the motors 56, 58 is thus imparted through the springs 66 to the unitary deck frame assembly.

Figure 7:
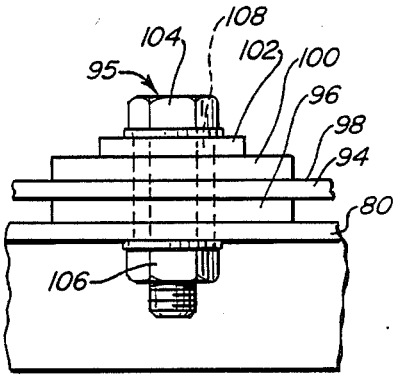
FIG. 7 is an enlarged, fragmentary, elevation view of a connection for a plate supporting a casting on the deck of the apparatus in FIGS. 1–4.

A horizontal, flat deck plate 94 is carried by the deck frame assembly above the plate 80. Details of one exemplary connection 95 between the plates 80, 94 are shown in FIG. 7. A flat washer 96 made of flexible material is interposed between the plates 80, 94. On the upper surface 98 of the plate 94 a like washer 100 is situated. A metal washer 102 overlies the washer 100. A bolt 104 is passed consecutively through the washer 102, the washer 100, plate 94, washer 96 and plate 80 and is secured by a nut 106. A cylindrical sleeve 108 is preferably provided around the bolt 104, as seen in FIG. 7. Nine such connections are shown clearly in the plan view of FIG. 2. The described connection permits a modicum of shifting of the plate 94 relative to the plate 80.

The clamps 18 are attached directly to the upper plate 94. These clamps 18 are of conventional construction and fixedly secure castings or the like to the deck plate 94. The details of construction of the clamp 18 are not important to the present invention.

The plate 94 has a plurality of apertures 110 which allow passage of sand or other foreign material dislodged from the castings to pass through the deck plate for separate recovery thereof. The apertures 110 prevent the detrimental accumulation of sand on the deck plate as might alter the vibrational characteristics of the apparatus.

The resulting system is a two mass system. One unitary mass consists of the side plates 38, force transmitting plate 40, exciter element 48 and the vibratory generating apparatus including motors 56, 58. The second mass consists of the aforementioned deck frame assembly 14. As previously mentioned, operation of the motors 56 and 58 vibrates the first mass in a generally straight line. Vibrational force is transmitted through the spring 66 to the unitary deck frame assembly so that the castings are likewise vibrated generally in a line parallel to the line 60.

According to the invention, a piston or knocker structure at 114 is incorporated into the deck frame assembly. The piston or knocker structure 114 is shown partially schematically in FIG. 6. The piston structure 114 consists of a casing 116 with a cylindrical wall 118 having a surface 120 defining a cylindrical piston chamber 122 with an axis parallel to the line of vibration. A piston 124 is loosely fit in the chamber 122 to reciprocate in the line of vibration. The chamber 122 is bounded at its forward end by a hammer plate 126. The hammer plate 126 is fixedly attached to the deck plate 94 and has a rearward surface 128 facing into the chamber. The plate is reinforced by a plurality of gussets 130 acting between a forwardly facing surface on the hammer plate 126 and the upper surface 98 of the deck plate 94. The chamber 123 is bounded at its rearward end by a second hammer plate 134 having a surface 136 facing forwardly towards the front hammer plate 126.

The piston 124 has a generally cylindrical body and enlarged, disk-shaped ends 138 which guide the piston 124 against the chamber surface 120 and abut the hammer plates 126, 134 at the ends of the chamber to arrest fore and aft movement of the piston 124. The piston 124 is made of a dense material such as a 13% mangalloy bar. The ends 138 are preferably made of T-1 steel for good durability.

The piston 124 starts to reciprocate in the chamber 122 in response to the vibration imparted through the vibratory generating apparatus. As the deck frame structure is vibrated, the piston ends 138 are forcibly driven against spaced hammer plates 126, 134. The impacting of the piston in the chamber adds a second and different vibration to the parts mounted in the deck assembly. The vibratory generating apparatus is tuned to provide a primary vibration which sets up a secondary impacting vibration. The combined two frequency impacting of the parts cleans the parts of adhered foreign matter and shakes out any core material in cavities in the casting. The piston or knocker adds the additional dimension to the vibration imparted through the vibratory assemblies, yet does not require alteration of the basic vibration imparting structure.

The vibration imparting structure 16, through control of the motors and eccentrics, can be driven at desired operating conditions, for instance, when driven at approximately 3200 rpm with a stroke of approximately $\frac{1}{4}$ the piston or knocker freely reciprocates in the chamber and ricochets off the hammer plates 126, 134 and as a result alternately bangs, raps or knocks the hammer plates 126, 134 alternatively at twice the deck frequency or at approximately 6400 cycles per minute. The movement of the deck and piston are synchronized but out of phase, which accounts for the improved shakeout characteristics for the apparatus.

Figure 3:
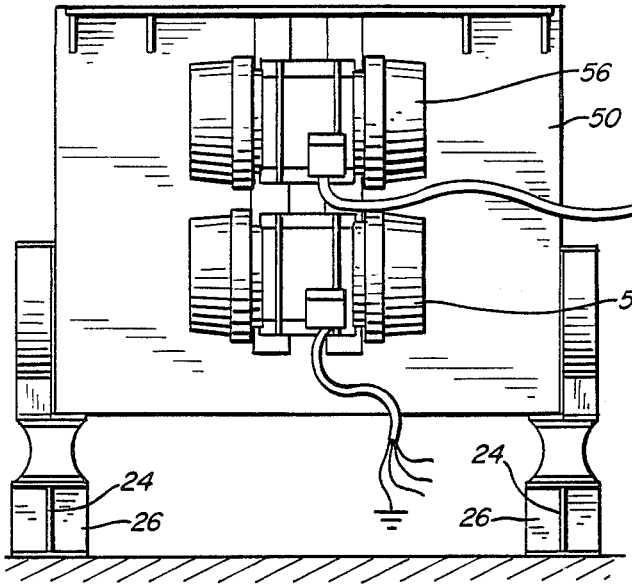
FIG. 3 is an elevation view from one end of the apparatus in FIGS. 1 and 2.
Figure 6:
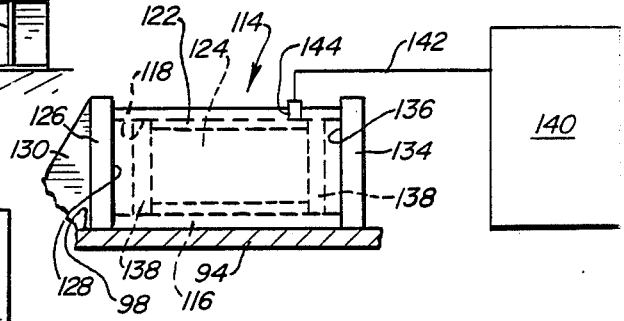
FIG. 6 is a schematic representation of a vibration imparting piston according to the present invention and carried on the deck of the apparatus in FIGS. 1–4.

As relative movement occurs between the piston and the casing 116, there is an appreciable heat buildup. Cooling structure 140, shown schematically in FIG. 6, is thus provided. The cooling structure preferably comprises an air supply which is forcibly delivered through a line 142 into the chamber 122 through a fitting 144 in the wall 118. Preferably, oil is added with the air supply at a rate of approximately 1 drop every 5 seconds. The oil in the form of a mist develops a cushion to prevent metal-to-metal contact between the piston 124, wall 118 and hammer plates 126, 138 reducing damage to the hammer plates and piston.

Operation of the apparatus can be altered by selectively varying the amplitude and frequency of the vibrations. To accomplish this, a motor control 150 of conventional construction is used to vary the amplitude and a separate motor control 152 alters the frequency of vibration imparted through the motors 56, 58. Both motors are operated in the same fashion to maintain the stability of the system. A variable force system such as shown in U.S. Pat. No. 4,168,724 to Musschoot or in U.S. Pat. No. 4,495,926 to Musschoot have produced excellent results in creating and controlling the vibratory forces for the shakeout and incoming apparatus.

I claim:

1. A vibratory apparatus comprising:

a deck;

means for resiliently supporting the deck relative to a surface bearing the vibratory apparatus;

means for supporting a casting or the like to be vibrated with the deck;

a piston;

means mounting the piston for free reciprocating movement relative to the deck;

said piston mounting means further including a hammer plate in the path of the free reciprocating movement of the piston; and means for imparting vibration to the deck to shake loose foreign matter adhered to a casting supported on the deck and for simultaneously freely reciprocating the piston against the hammer plate to jolt the deck and supported casting to alter and augment the vibrating action imparted to the casting through the vibration means.

2. The vibratory apparatus according to claim 1 wherein means mount the vibration imparting means so that vibrations are imparted to the deck along a substantially horizontal line.

3. The vibratory apparatus according to claim 1 wherein means are provided to vary the amplitude of vibrations imparted to the deck and a supported casting through the vibration imparting means.

4. The vibratory apparatus according to claim 1 wherein means are provided to vary the frequency of vibrations imparted to the deck and a supported casting through the vibration imparting means.

5. The vibratory apparatus according to claim 1 wherein said hammer plate has a first surface against which the piston impacts, said piston mounting means has a second hammer plate with a second surface facing the first surface and also in the path of reciprocating movement of the piston, the piston has spaced ends and the vibration imparting means alternatingly drives one piston end against the one hammer plate surface and the other piston end against the second hammer plate surface to jolt the deck and a supported casting alternatingly in opposite directions.

6. The vibratory apparatus according to claim 1 wherein the means for resiliently supporting the deck comprises an exciter, resilient supports between the exciter and a rigid surface for bearing the vibrating apparatus, and resilient means connecting between the deck and the exciter and serving as the sole support for the deck.

7. The vibratory apparatus according to claim 1 wherein said piston mounting means comprises a casing defining a chamber within which the piston reciprocates and means are provided to cool the piston chamber.

8. The vibratory apparatus according to claim 1 wherein said deck has a horizontal plate and the means supporting a casting comprises a clamp means on the horizontal plate for fixedly holding a casting relative to the horizontal plate.

9. The vibratory apparatus according to claim 6 wherein said resilient means connecting between the deck and exciter comprises a plurality of coil springs.

10. The vibratory apparatus according to claim 8 wherein said horizontal plate has a plurality of apertures therethrough to allow the passage of foreign matter dislodged from a casting supported on the deck.

11. A vibratory apparatus comprising:

a deck;

clamp means on the deck for substantially fixedly mounting a casting or the like to the deck;

means resiliently supporting the deck relative to a surface bearing the vibratory apparatus;

a hammer plate;

means fixedly mounting the hammer plate to the deck;

a piston;

means mounting the piston for movement relative to the hammer plate; and means for imparting vibration to the deck to shake loose foreign matter adhered to a casting supported on the deck plate and for simultaneously intermittently driving the piston against the hammer plate to jolt the deck and a supported casting to alter and augment the vibrations imparted to the supported casting through the vibration imparting means.

12. The vibratory apparatus according to claim 11 wherein means mount the vibration imparting means so that vibrations are imparted to the deck along a substantially horizontal line and the means mounting the piston mount the piston for translatory movement substantially parallel to the line of vibration of the deck.

13. The vibratory apparatus according to claim 11 wherein said vibration imparting means comprises an exciter, means resiliently mounting the exciter relative to a rigid surface bearing the vibrating apparatus, means resiliently supporting the deck from the exciter and at least one motor having a shaft with an eccentric weight thereon to vibrate the exciter.

14. The vibratory apparatus according to claim 11 wherein said vibration imparting means has an exciter plate with means resiliently mounting the exciter plate relative to a rigid surface bearing the vibratory apparatus and means for vibrating the exciter plate, the deck has a force transmission plate and a first plate rigidly attached to the force transmission plate, resilient means are attached between the exciter plate and force transmission plate to support the transmission plate and transmit thereto vibratory forces for the exciter plate, a second plate is provided on the deck, means mount the clamp means on the second plate and means resiliently attach the second plate to the first plate and the force transmission plate.

15. A vibratory apparatus comprising:

a vertically disposed exciter resiliently supported on a base;

a vibration generating structure mounted on said exciter and adapted to produce vibratory forces in a horizontal direction;

a deck resiliently supported in horizontally spaced relationship to the exciter, said deck having means for supporting a casting thereon; and a second vibration producing means carried by said deck, said second vibration producing means comprising a freely reciprocating piston mounted for movement between members fixed on said deck, said piston reciprocating in a horizontal direction coinciding with the horizontal direction of the vibratory forces of the vibration generating structure, said vibration generating structure vibrating said deck and casting with one frequency and said piston under the influence of said vibration generating structure setting up a second and higher frequency, said combined frequencies shaking out and loosening foreign material on the casing.

* * * * *